US007049276B2

(12) United States Patent
Altmann et al.

(10) Patent No.: US 7,049,276 B2
(45) Date of Patent: May 23, 2006

(54) CLOTHES TREATMENT FOR DRY WRINKLE RESISTANCE UTILIZING AN AMINOSILICONE CONTAINING A STERICALLY HINDERED FUNCTIONAL GROUP

(75) Inventors: Markus Wilhelm Altmann, Brussels (BE); Bruno Albert Jean Hubesch, Neerijse-Huldenberg (BE); Heidi Simonne Mariette Soyez, Oostende (BE)

(73) Assignee: The Procter & Gamble Company, Cincinnati, OH (US)

( * ) Notice: Subject to any disclaimer, the term of this patent is extended or adjusted under 35 U.S.C. 154(b) by 356 days.

(21) Appl. No.: 10/038,319

(22) Filed: Oct. 19, 2001

(65) Prior Publication Data

US 2002/0137651 A1 Sep. 26, 2002

(51) Int. Cl.
*C11D 9/30* (2006.01)
*C11D 9/36* (2006.01)

(52) U.S. Cl. ..... 510/287; 510/276; 510/101; 510/327; 510/466; 510/515; 510/499

(58) Field of Classification Search ..... 510/276, 510/287, 101, 327, 466, 515, 499
See application file for complete search history.

(56) References Cited

U.S. PATENT DOCUMENTS

| | | | | | |
|---|---|---|---|---|---|
| 5,075,403 | A | * | 12/1991 | Kirk | 528/15 |
| 5,147,578 | A | * | 9/1992 | Kirk | 510/513 |
| 5,277,968 | A | * | 1/1994 | Canivenc | 442/102 |
| 5,540,952 | A | * | 7/1996 | Canivenc et al. | 427/387 |
| 5,688,889 | A | * | 11/1997 | Canivenc et al. | 528/40 |

FOREIGN PATENT DOCUMENTS

| | | | | |
|---|---|---|---|---|
| EP | 1 081 271 | A1 | | 3/2001 |
| WO | WO 96/15309 | A2 | | 5/1996 |
| WO | 97/33034 | | * | 9/1997 |
| WO | WO 97/33034 | A1 | | 9/1997 |
| WO | WO 98/49220 | A1 | | 11/1998 |
| WO | WO 02/29152 | A1 | | 4/2002 |

* cited by examiner

*Primary Examiner*—Charles Boyer
(74) *Attorney, Agent, or Firm*—David V. Upite

(57) ABSTRACT

The invention concerns the treatment of clothes for dry wrinkle resistance, in particular in-wear wrinkle resistance. The clothes are treated with an amino silicone, preferably one that contains sterically hindered functional groups. The silicone is preferably provided to the clothes in a domestic process, preferably during a process of ironing.

8 Claims, No Drawings

CLOTHES TREATMENT FOR DRY WRINKLE RESISTANCE UTILIZING AN AMINOSILICONE CONTAINING A STERICALLY HINDERED FUNCTIONAL GROUP

TECHNICAL FIELD

The invention relates to the treatment of clothes for dry wrinkle resistance, and in particular in-wear wrinkle resistance. The clothes are treated with an amino silicone, preferably one that comprises an amine comprising a sterically hindered functional group. The silicone is preferably provided to the clothes in a domestic process, preferably during a process of ironing.

BACKGROUND

Treatments of clothes to confer to them various properties have been extensively discussed in the art. In particular, an area of constant research is the area of wrinkle reduction. That is, worn clothes are generally wrinkled to a lesser or greater degree, and the process of laundering generally increases the wrinkling of clothes. Thus, chemicals have been provided to diminish the wrinkling of clothes. The use of such chemicals, combined with the traditional process of ironing provides for clothes which are clean and dewrinkled.

However, such clean and dewrinkled clothes will re-wrinkle as soon as they are worn, and before that while they are stored waiting to be worn. Thus the dewrinkling of clothes described above is at best a very temporary achievement. It is thus an object of the present invention to provide a solution to the problem of dry wrinkle formation, i.e. the formation of wrinkles when dry clothes are stored waiting to be worn, and while clothes are worn (i.e. in-wear wrinkle formation).

To our knowledge, the prior art has not addressed this particular problem. Aminosilicones have been described for the treatment of clothes in numerous publications, but only for the benefit of softening clothes or gliding benefit in ironing aids. It is also generally suggested in the art that all fabric softeners have the ability to dewrinkle clothes, but the particular problem of preventing the formation of wrinkles is not discussed. The use of aminosilicones to treat clothes in a domestic context has been disclosed for instance in U.S. Pat. Nos. 5,062,971, 5,064,543, WO 00/24853, WO/9201773, EP 300 525, EP 150 867, EP 150 872. The use of aminosilicones comprising sterically hindered functional groups to treat textiles in an industrial context has been disclosed in U.S. Pat. No. 5,540,952, EP 659 930, WO 00/5315. And processes for the manufacture of such aminosilicones have been disclosed in U.S. Pat. No. 5,688,889, WO 96/16110, WO 96/16124, WO 96/16127, WO 96/18667 and U.S. Pat. No. 5,792,825.

SUMMARY OF THE INVENTION

In one embodiment, the present invention encompasses the use of an aminosilicone for the treatment of clothes, for the benefit of dry wrinkle resistance, in particular in-wear wrinkle resistance.

In another embodiment, the present invention encompasses a process for the domestic treatment of clothes where said clothes are treated with an aminosilicone comprising an amine comprising a sterically hindered functional group.

In yet another embodiment, the present invention encompasses compositions for the domestic treatment of clothes where clothes are treated with aminosilicones comprising a sterically hindered functional group.

Finally, the present invention also encompasses an article of manufacture comprising an aminosilicone comprising an amine comprising a sterically hindered functional group, and usage instructions to use said aminosilicone for the treatment of clothes.

DETAILED DESCRIPTION OF THE INVENTION

The Benefit:

In the present invention, it has been discovered that aminosilicones can be used to treat clothes so as to provide the benefits of dry wrinkle resistance, i.e. the resistance to the formation of wrinkles when fabrics are dry, waiting to be worn, and while fabrics are being worn (i.e. in-wear wrinkle resistance). This benefit is to be distinguished from the well-known and extensively discussed benefit of dewrinkling. Indeed, a particular compound may have the ability to dewrinkle clothes without conferring to fabrics the ability to resist to the formation of new wrinkles, as the dry clothes await to be worn, or while they are worn. In the present invention, a fabric treated with an aminosilicone will show fewer wrinkles than an untreated fabric after storage, and after having been worn.

The Aminosilicones:

In the present invention, any known aminosilicone can be used to treat clothes so as to provide the desired benefit. Aminosilicones used in a domestic context have been described in numerous publications, for instance U.S. Pat. Nos. 5,062,971 and 5,064,543 as ironing aid; in WO 00/24853, WO/9201773 and EP 300 525 in fabric conditioners, EP 150 867 and EP 150 872 in detergents and there is no need to redescribe such aminosilicones herein.

However, a particular problem that arises with most aminosilicones is that they eventually yellow fabrics. The phenomenon for such yellowing is not well understood, but it does create a practical limitation to the use of aminosilicones to treat clothes: amino silicones can be used to treat clothes, but only in limited amounts such that the yellowing phenomenon does not become too visible, thereby limiting the performance of the composition.

It has now been found that there exists a particular class of amino silicones which is suitable for use in a domestic context and which does not yellow fabrics. Such silicones have been discussed in, e.g. U.S. Pat. No. 5,688,889 as well as U.S. Pat. No. 5,540,952, but only for use in an industrial context, and for a different benefit. In particular, in example 3 of those documents, a process is described in which fabrics are immersed in a solution of the amino silicone in white spirit, and the fabrics are subsequently dried at 40° C. for 15 minutes in a ventilated oven and then heated at 160° C. for 30 min. This pad-dry-cure process is a standard process in textile industry, but it cannot be performed in a domestic context. This particular class of amino silicones is referred throughout this description as aminosilicones comprising a sterically hindered functional group. Such aminosilicones have been described in U.S. Pat. No. 5,540,952, EP 659 930, WO 00/5315, U.S. Pat. No. 5,688,889, WO 96/16110, WO 96/16124, WO 96/16127, WO 96/18667 and U.S. Pat. No. 5,792,825, the contents of which are incorporated herein.

The present invention utilizes amino silicones comprising a sterically hindered functional group, i.e. polyorganosiloxanes having, per mole, at least one unit of general formula:

$$(R)_a(X)_bZSi(O)_{\frac{3-(a+b)}{2}}$$

in which:

The symbols R are identical or different and represent a monovalent hydrocarbon radical chosen from linear or branched alkyl radicals having from 1 to 4 carbon atoms, the phenyl radical, the benzyl radical and the 3,3,3-trifluoropropyl radical;

The symbols X are identical or different and represent a monovalent radical chosen from a hydroxyl group and a linear or branched alkoxy radical having from 1 to 3 carbon atoms;

The symbol Z represents a monovalent group of the formula $R^1$—U—S in which:

$R^1$ is a divalent hydrocarbon radical chosen from:

- linear or branched alkylene radicals having from 2 to 18 carbon atoms;
- alkylenecarbonyl radicals in which the linear or branched alkylene part contains 2 to 20 carbon atoms;
- alkylenecyclohexylene radicals in which the linear or branched alkylene part contains from 2 to 12 carbon atoms and the cyclohexylene part contains an —OH group and optionally 1 or 2 alkyl radicals having from 1 to 4 carbon atoms;
- radicals of the formula $R^2$—O—$R^3$— in which the radicals $R^2$ and $R^3$, which are identical or different, represent alkylene radicals having 1 to 12 carbon atoms;
- radicals of the formula $R^2$—O—$R^3$— in which the radicals $R^2$ and $R^3$ have the meanings indicated above and one of them or both are substituted by one or two —OH group(s);
- radicals of the formula $R^2$—COO—$R^3$— and $R^2$—OCO—$R^3$— in which the radicals $R^2$ and $R^3$ have the meanings above;
- radicals of the formula $R^4$—O—$R^5$—O—CO—$R^6$— in which the radicals $R^4$, $R^5$ and $R^6$, which are identical or different, represent alkylene radicals having 2 to 12 carbon atoms and the radical $R^5$ is optionally substituted by a hydroxyl group;
- radicals of the formula

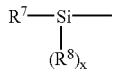

in which the radical $R^7$ represents alkylene radicals having 1 to 4 carbon atoms, and the radical $R^8$ represents linear or branched alkylene radicals having 1 to 4 carbon atoms, the phenyl radical and the phenylalkyl radical where the linear or branched alkyl part contains 1 to 3 carbon atoms; and where x is a number chosen between 0, 1 and 2.

U represents —O— or —$NR^9$—, $R^9$ being a radical chosen from a hydrogen atom, a linear or branched alkyl radical having from 1 to 6 carbon atoms, a divalent radical —$R^1$— having the meaning indicated above, one of the valency bonds being connected to the nitrogen of —$NR^9$— and the other being connected to a silicon atom and a divalent radical of the formula —$R^{10}$—N($R^1$)—S in which $R^1$ has the meaning indicated above, and $R^{10}$ represents a linear or branched alkylene radical having from 1 to 12 carbon atoms, one of the valency bonds (that of $R^{10}$) being connected to the nitrogen atom of —$NR^9$— and the other (that of $R^1$) being connected to a silicon atom.

S represents a monovalent group, in which:

- the free valency is a carbon atom, carrying a secondary or tertiary amine function, comprised in a cyclic hydrocarbon chain or in a heterocyclic chain comprising from 6 to 30 carbon atoms, in which the two atoms of the cyclic chain in the positions α and α' relative to the nitrogen atom, do not comprise any hydrogen atom;
- the free valency is a carbon atom, carrying a secondary or tertiary amine function, comprised in a linear hydrocarbon chain comprising 6 to 40 carbon atoms, in which the two atoms of the cyclic chain in the positions α and α' relative to the nitrogen atom, do not comprise any hydrogen atom.

Preferably, the secondary or tertiary amine function in S is incorporated in a piperidyl group.

a is a number chosen from 0, 1 and 2;

b is a number chosen from 0, 1 and 2;

the sum a+b is not greater than 2.

The polyorganosiloxane used can additionally comprise (an) other siloxyl unit(s).

Such amino silicones comprising a sterically hindered functional group which are suitable for use herein are commercially available from Rhodia under the trade name Rhodorsil®, in particular Rhodorsil® H 21645 or Rhodorsil® H 21650 or Silicex®, in particular Silicex® 263.

In the present invention, thanks to their ability not to yellow fabrics, the aminosilicones comprising a sterically hindered functional group can be provided to the clothes in amounts from $1\times10^{-7}$ g/g fabric to 0.3 g/g fabric, preferably from $1\times10^{-5}$ g/g fabric to 0.1 g/g fabric; more preferably from $1\times10^{-3}$ g/g fabric to $1\times10^{-2}$ g/g fabric, i.e. in amounts which are greater than the amounts in which other amino silicones can be used. Thus, a greater benefit can be obtained without observing fabric yellowing.

The Domestic Treatment, and the Respective Compositions and Articles of Manufacture In the present invention, the aminosilicones comprising a sterically hindered functional group are provided to clothes in a domestic treatment.

In a first embodiment of the domestic process, the aminosilicone comprising a sterically hindered functional group herein can be provided in a detergent composition, which will contain conventional detergency ingredients. The detergent can be a granular, solid, i.e. a block or a tablet, or a liquid. It is not necessary to describe here in detail suitable detergency ingredients, in particular detergent surfactants, and detergent compositions comprising conventional aminosilicones have been described in EP 150 867 and EP 150 872. The description of detergent compositions in those two documents is incorporated herein by reference. In this embodiment, the aminosilicone is provided to the fabric during the conventional laundering process. In a detergent composition, the aminosilicone comprising a sterically hindered functional group will be present in amounts ranging from 0.05% to 10%; preferably from 0.1% to 5% so as to be provided to clothes in the required amounts.

In a second embodiment of the domestic process, the aminosilicone comprising a sterically hindered functional group is provided to the clothes together with the last rinse in the laundering process. In this embodiment, the aminosilicone can be added to the rinse water as a standalone product, or it can be added to the rinse water as a component of a fabric conditioner. Fabric conditioners comprising aminosilicones have been disclosed in WO 00/24853, WO/9201773 and EP 300 525. The description of fabric conditioners in those three documents is incorporated herein by reference. In a fabric conditioner, or as a standalone product the amino silicone comprising a sterically hindered functional group will be present in amounts ranging from 0.1% to 25%; preferably from 0.3% to 15%; more preferably from 0.5% to 10% so as to be provided to clothes in the required amounts.

In a third and preferred embodiment of the domestic process, the aminosilicone comprising a sterically hindered functional group is provided to the clothes after the laundering process, when the clothes are wet, damp or dry. In this embodiment, the aminosilicone can be provided to the fabrics by a variety of means, such as brushing, spraying, or releasing from a substrate in an automatic clothes dryer. When sprayed, which is the preferred embodiment herein, the aminosilicones can be sprayed from a sprayer or an aerosol as a standalone product, or from an iron. When dispensed from an iron, the aminosilicone is either introduced in and dispensed from the iron's water tank as in EP 629 736, or from a separate reservoir in the iron as in U.S. Pat. No. 3,160,969, or by means of a cartridge to be inserted in the iron for the dispensing of its content as in WO99/27176. If designed as a standalone product to be used as a spray, the composition will generally comprise the aminosilicone comprising the sterically hindered functional group in amounts from 0.01% to 50%; preferably from 0.1 % to 30%; more preferably from 0.5% to 25%. If the amino silicone is to be released from a substrate in an automatic clothes dryer, the substrate will generally comprise the aminosilicone in amounts of from 0.1% to 20%; preferably from 2% to 20%.

It is a preferred embodiment that the aminosilicone be sprayed onto the clothes and that—before and/or during and/or after spraying, the clothes be ironed. In other words, it is preferred that the aminosilicone be used as an ironing product.

In all embodiments, the amino silicone is preferably formulated as an aqueous solution or emulsion. Besides water and amino silicones, and the various ingredients required for the specific embodiment concerned (i.e. detergency surfactants for detergents, fabric softeners for fabric conditioners, etc . . . ), the aqueous dispersion may comprise other ingredients. In a preferred embodiment of the invention the aminosilicone comprising a sterically hindered functional group is formulated in a composition together with an ingredient selected from the group consisting of a shape-retention polymer as in co-pending application EP 99870223.7, or a fabric void filler, or mixtures thereof. By fabric void filler, it is meant herein particles having the size and shape suited to fill the structural defects in cotton, and hereby provide lubricating properties. Cyclodextrins such as those described in WO 99/55950 can be used as void fillers, as well as polyolefin dispersions, such as those described in U.S. Pat. No. 6,020,302.

The compositions herein may of course further comprise minor ingredients, mainly perfume.

The present invention also encompasses articles of manufacture comprising the aminosilicone polymer and usage instructions to use the aminosilicone for the benefit of dry wrinkle resistance. Those instructions will depend on the specific embodiment which is chosen. If the aminosilicone composition is used as an ironing product, it is preferably contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. If the aminosilicone is delivered to clothes in the last rinse of a normal laundry cycle, the composition is contained in a container which is labeled with instructions, or accompanied with a leaflet bearing instructions to use the composition during the last rinse of a normal laundry cycle, and to secure the clothes in the desired configuration. If the aminosilicone is formulated in a detergent composition, the composition is contained in a container which is labeled with instructions, or accompanied with a leaflet bearing instructions to use the composition in a normal laundry cycle, and to secure the clothes in the desired configuration.

EXAMPLES

The invention is illustrated by the further examples, in which percentages are on a weight basis unless otherwise stated.

Example 1

Conventional Aminosilicone in a Spray-on

| | Composition A | Composition B |
|---|---|---|
| Mirasil ADM-E 1 | 5% | — |
| Ultratex SW 2 | — | 2.5% |
| Luviquat FC905 3 | 2% | 0.75% |
| Luvitec VPC 4 | — | 0.75% |
| Silwet L 7200 5 | 3% | — |
| Radiasurf 7137 6 | — | 5% |
| Silwet L 77 7 | 0.75% | 1% |
| Velustrol P-40 8 | 2.25% | — |
| Emulsifier 9 | 0.6% | 1.25% |
| Preservative | 3 ppm | 3 ppm |
| Perfume | 0.5% | 1% |
| Water | Balance | Balance |

1 Microemulsified linear aminosilicone from Rhodia (34% active)
2 Microemulsified linear aminosilicone from Ciba (14% active)
3 Co-polymer of vinylpyrrolidone and vinylimidazolium methachloride from BASF (40% active)
4 Co-polymer of vinylpyrrolidone and vinylcaprolactam from BASF (31% active)
5 Polyalkylene oxide polysiloxane from Crompton (100% active)
6 Polyethoxylated (20 moles) sorbitan monolaureate from Fina (100% active)
7 Polyalkylene oxide polysiloxane from Crompton (100% active)
8 Oxidezed polyolefin wax from Hoechst (41% active)
9 CAE 10, coconut alcohol condensed with an average of 10 moles of ethylenoxide from Hoechst (100% active)

Each composition is contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. The fabrics are less prone to dry-wrinkle formation than other fabrics which were ironed without having been sprayed with the exemplified composition.

Example 2

Sterically Hindered Aminosilicone in a Spray-on

| | Composition A | Composition B |
|---|---|---|
| Silicex 263 1 | 5% | 1% |
| Luviquat FC905 2 | 2% | 1% |
| Luviskol K30 3 | — | 0.75% |
| Silwet L 7200 4 | 3% | — |
| β-cyclodextrin 5 | 2% | — |
| Silwet L 7600 6 | 0.75% | 0.25% |
| Emulsifier 7 | 0.6% | 1.25% |
| Preservative | 3 ppm | 2 ppm |
| Perfume | 0.3% | 1% |
| Water | Balance | Balance |

1 Microemulsified sterically hindered cyclic aminosilicone from Rhodia (40% active)
2 Co-polymer of vinylpyrrolidone and vinylimidazolium methachloride from BASF (40% active)
3 Polyvinylpyrrolidone from BASF (100% active)
4 Polyalkylene oxide polysiloxane from Crompton (100% active)
5 Cyclodextrin from Wacker (100% active)
6 Polyalkylene oxide polysiloxane from Crompton (100% active)
7 CAE 10, coconut alcohol condensed with an average of 10 moles of ethylenoxide from Hoechst (100% active)

This composition is contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. The fabrics are less prone to dry-wrinkle formation than other fabrics which were ironed without having been sprayed with the exemplified composition.

Example 3

Sterically Hindered Aminosilicone in a Fabric Conditioner

| | Composition A |
|---|---|
| Rewoquat V3282 1 | 20 |
| Silicex 263 2 | 2.5 |
| CaCl2 | 0.15 |
| Perfume | 0.75 |
| Dye solution | 0.025 |
| HEDP 3 | 0.02 |
| HCl | 0.02 |
| Water | Balance |

1 DEEDMAC Diethylester dimethylammonium chloride from Crompton (85% active)
2 Microemulsified sterically hindered cyclic aminosilicone from Rhodia (40% active)
3 Hydroxyethylidene-1,1-diphosphonic acid from Albright and Wilson (59% active)

This composition is used to treat fabrics in the last rinse of a normal laundry cycle. The composition is contained in a container which is labeled with instructions, or accompanied with a leaflet bearing instructions to use the composition during the last rinse of a normal laundry cycle. The fabrics are then dried and ironed. Those fabrics are less prone to dry-wrinkle formation than other fabrics which were ironed without having been conditioned with the exemplified composition, and are less yellowed.

Example 4

Sterically Hindered Aminosilicone in a Detergent

| | Composition A | Composition B |
|---|---|---|
| LAS | 8 | 6 |
| AO | 0.5 | — |
| TAE-11 | 1 | — |
| C13-15EO7 | — | 3.75 |
| C16-20 Fatty acid | — | 1 |
| STPP | 24 | 23 |
| Silicate 1.6 | 8.0 | — |
| Smectite clay | 2.5 | — |
| Copolymer AA/MA | 1.6 | — |
| Glycerol | — | 5 |
| Sodium borate | — | 2.0 |
| DTMA | 3.8 | — |
| HFA | 1.5 | — |
| CMC | 0.4 | — |
| Optical brightener | 0.23 | — |
| EDTA | 0.2 | — |
| STS | 0.65 | — |
| Perborate | 20.0 | — |
| Silicex 263 | 2.0 | 2.5 |
| TAE-5 | 0.5 | — |
| Enzymes | 0.5 | 0.5 |
| Photobleach activator | 25 ppm | — |
| Copper-EDTA | 30 ppm | — |
| SRS I | 2.7 | — |
| Perfume/water/sodium sulfonate/perfume | Balance | Balance |

The abbreviations for the individual ingredients of the examples have the following meaning:
LAS: Sodium salt of linear dodecyl benzene sulfonate from Condea (96% active)
AO: C12-14 alkyl dimethylamine oxide from Albright and Wilson (32% active)
TAE-5: Tallow alcohol ethoxylated with about 5 moles of ethylene oxide from Witco (100% active)
TAE-11: Tallow alcohol ethoxylated with about 11 moles of ethylene oxide from Witco (100% active)
STPP: Sodium tripolyphosphate from Rhone-Poulenc (100% active)
Copolymer AA/MA: copolymer of acrylic acid 40 mole % and maleic acid 60 mole % from BASE (30% active)
CMC: Sodium salt of carboxymethylcellulose from Sigma (100% active)
HFA: hydrogenated C16-22 fatty acid from Clariant (100% active)
DTMA: Ditallow methylamine from Clariant (100% active)
Smectite clay: Natural smectite having $CaCO_3$ ion-exchange capacity of 95 meq/100 g clay from R. T. Vanderbilt Comp. (100% active)
STS: toluene sulfonate from Albright and Wilson (100% active)
EDTA: Sodium salt of ethylene diamine tetra-acetate from BASF (100% active)
Perborate: $NaBO_3.H_2O_2.\ 3H_2O$ from Solvax Interox (100% active)
Photobleach activator: Mixture of sulfonated tetra- and trisulfonated zinc phtalocyamine in a ratio of tetra to trio of approximately 20:1 from Ciba (100% active)
Silicex 263: Microemulsified sterically hindered cyclic aminosilicone from Rhodia (40% active)
SRS I: Prilled suds regulating system consisting of a) 77.5% STPP; b) 22.5% active; 13.5% paraffin oil, 6% paraffin wax (MP 70° C.); 3% amorphous hydrophobic silica.
Enzymes: Mixture of proteases and amylases in a ratio of 1:1 from Novo
$C_{x-y}EO_n$: $C_{x-y}$ alcohol ethoxylated with n moles of ethylene oxide from BASF (100% active)

These compositions are used to treat fabrics in a normal laundry cycle. Each composition is contained in a container which is labeled with instructions, or accompanied with a leaflet bearing instructions to use the composition in a normal laundry cycle. The fabrics are then dried and ironed. Those fabrics are less prone to dry-wrinkle formation than other fabrics which were ironed without having been washed with the exemplified detergent composition.

What is claimed is:

1. A process for the domestic treatment of clothes, said process comprising the steps of:

a) obtaining a composition comprising a perfume and from $1\times10^{-7}$ g/g fabric to about 0.3 g/g fabric of an aminosilicone containing a sterically hindered functional group;

b) adding said composition to either a domestic laundry machine or a domestic manual trigger sprayer;

c) contacting said clothes with said composition either in said domestic laundry machine or with said domestic manual trigger sprayer.

2. The method of claim 1, wherein the aminosilicone is provided in amounts of from about $1\times10^{-5}$ g/g fabric to about 0.1 g/g fabric.

3. The method of claim 2, wherein the aminosilicone is provided in amounts of from about $1\times10^{-3}$ g/g fabric to $1\times10^{-2}$ g/g fabric.

4. The method of claim 1, wherein the aminosilicone is provided to said clothes:

with the last rinse of a conventional laundry cycle;

after the laundering process on said clothes in wet, damp or dry condition; or in a detergent composition.

5. The method of claim 1, wherein said aminosilicone is sprayed onto the clothes during a process of ironing the clothes.

6. The method of claim 1, wherein the aminosilicone comprises a polyorganosiloxane having, per mole, at least one unit of general formula:

$$(R)_a(X)_bZSi(O)_{\frac{3-(a+b)}{2}}$$

wherein:

each R is a monovalent hydrocarbon chosen from linear or branched alkyls having from 1 to 4 carbon atoms, the phenyl radical, the benzyl radical or the 3,3,3-trifluoropropyl radical;

each X is a monovalent radical chosen from a hydroxyl group and a linear or branched alkoxy radical having from 1 to 3 carbon atoms;

Z represents a monovalent group of the formula:

$R^1$—U—S wherein each $R^1$ is a divalent hydrocarbon radical chosen from:

linear or branched alkylenes having from 2 to 18 carbon atoms;

alkylenecarbonyls in which the linear or branched alkylene part contains 2 to 20 carbon atoms;

alkylenecyclohexylenes in which the linear or branched alkylene part contains from 2 to 12 carbon atoms and the cyclohexylene part contains an —OH group and optionally 1 or 2 alkyls having from 1 to 4 carbon atoms;

radicals of the formula $R^2$—O—$R^3$— in which $R^2$ and $R^3$ is each an alkylene having 1 to 12 carbon atoms;

radicals of the formula $R^2$—O—$R^3$— in which $R^2$ and $R^3$ have the meanings indicated above and one of them or both are substituted by one or two —OH group(s);

radicals of the formula $R^2$—COO—$R^3$— and $R^2$—OCO—$R^3$— wherein $R^2$ and $R^3$ have the meanings above;

radicals of the formula $R^4$—O—$R^5$—O—CO—$R^6$— wherein $R^4$, $R^5$ and $R^6$, each is an alkylene having 2 to 12 carbon atoms and wherein $R^5$ is optionally substituted by a hydroxyl group;

radicals of the formula

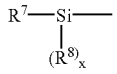

wherein $R^7$ is an alkylene having 1 to 4 carbon atoms, and $R^8$ is a linear or branched alkylene having 1 to 4 carbon atoms, phenyl or a phenylalkyl wherein the linear or branched alkyl part contains 1 to 3 carbon atoms; and where x is a number chosen between 0, 1 and 2;

each U represents —O— or —$NR^9$—, wherein $R^9$ is hydrogen, a linear or branched alkyl radical having from 1 to 6 carbon atoms, $R^1$ wherein one of the valency bonds being connected to the nitrogen of —$NR^9$— and the other being connected to a silicon atom or a divalent radical of the formula —$R^{10}$—N($R^1$)—S wherein $R^1$ has the meaning indicated above and $R^{10}$ represents a linear or branched alkylene having from 1 to 12 carbon atoms, one of the valency bonds (that of $R^{10}$) being connected to the nitrogen atom of —$NR^9$— and the other (that of $R^1$) being connected to a silicon atom;

each S represents a monovalent group, wherein the free valency is a carbon atom, carrying a secondary or tertiary amine function, comprised in a cyclic hydrocarbon chain or in a heterocyclic chain comprising from 6 to 30 carbon atoms, in which the two atoms of the cyclic chain in the positions α and α' relative to the nitrogen atom, do not comprise any hydrogen atom;

the free valency is a carbon atom, carrying a secondary or tertiary amine function, comprised in a linear hydrocarbon chain comprising 6 to 40 carbon atoms, in which the two atoms of the cyclic chain in the positions α and α' relative to the nitrogen atom, do not comprise any hydrogen atom;

each a is a number chosen from 0, 1 and 2;

each b is a number chosen from 0, 1 and 2, wherein the sum a+b is not greater than 2.

7. An article of manufacture comprising:

a) a composition wherein the composition comprises a perfume and from $1\times10^{-7}$ g/g fabric to about 0.3 g/g fabric of an aminosilicone containing a sterically hindered functional group; and b) a domestic manual trigger sprayer.

8. The article according to claim 7, wherein the aminosilicone comprises a polyorganosiloxane having, per mole, at least one unit of general formula:

$$(R)_a(X)_bZSi(O)_{\frac{3-(a+b)}{2}}$$

wherein each R is a monovalent hydrocarbon chosen from linear or branched alkyls having from 1 to 4 carbon atoms, the phenyl radical, the benzyl radical or the 3,3,3-trifluoropropyl radical;

each X is a monovalent radical chosen from a hydroxyl group and a linear or branched alkoxy radical having from 1 to 3 carbon atoms; Z represents a monovalent group of the formula:

$R^1$—U—S wherein each $R^1$ is a divalent hydrocarbon radical chosen from:

linear or branched alkylenes having from 2 to 18 carbon atoms;

alkylenecarbonyls in which the linear or branched alkylene part contains 2 to 20 carbon atoms;

alkylenecyclohexylenes in which the linear or branched alkylene part contains from 2 to 12 carbon atoms and the cyclohexylene part contains an —OH group and optionally 1 or 2alkyls having from 1 to 4 carbon atoms;

radicals of the formula $R^2$—O—$R^3$— in which $R^2$ and $R^3$ is each an alkylene having 1 to 12 carbon atoms;

radicals of the formula $R^2$—O—$R^3$— in which $R^2$ and $R^3$ have the meanings indicated above and one of them or both are substituted by one or two —OH group(s);

radicals of the formula $R^2$—COO—$R^3$— and $R^2$—OCO—$R^3$— wherein $R^2$ and $R^3$ have the meanings above;

radicals of the formula $R^4$—O—$R^5$—O—CO—$R^6$— wherein $R^4$, $R^5$ and $R^6$, each is an alkylene having 2 to 12 carbon atoms and wherein $R^5$ is optionally substituted by a hydroxyl group;

radicals of the formula

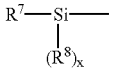

wherein $R^7$ is an alkylene having 1 to 4 carbon atoms, and $R^8$ is a linear or branched alkylene having 1 to 4 carbon atoms, phenyl or a phenylalkyl wherein the linear or branched alkyl part contains 1 to 3 carbon atoms; and where x is a number chosen between 0, 1 and 2;

each U represents —O— or —$NR^9$—, wherein $R^9$ is hydrogen, a linear or branched alkyl radical having from 1 to 6 carbon atoms, $R^1$ wherein one of the valency bonds being connected to the nitrogen of —$NR^9$— and the other being connected to a silicon atom or a divalent radical of the formula —$R^{10}$—N($R^1$)—S wherein $R^1$ has the meaning indicated above and $R^{10}$ represents a linear or branched alkylene having from 1 to 12 carbon atoms, one of the valency bonds (that of $R^{10}$) being connected to the nitrogen atom of —$NR^9$— and the other (that of $R^1$) being connected to a silicon atom;

each S represents a monovalent group, wherein the free valency is a carbon atoms, carrying a secondary or tertiary amine function, comprised in a cyclic hydrocarbon chain or in a heterocyclic chain comprising from 6 to 30 carbon atoms, in which the two atoms of the cyclic chain in the positions α and α' relative to the nitrogen atom, do not comprise any hydrogen atom;

the free valency is a carbon atom, carrying a secondary or tertiary amine function, comprised in a linear hydrocarbon chain comprising 6 to 40 carbon atoms, in which the two atoms of the cyclic chain in the positions α and α relative to the nitrogen atom, do not comprise any hydrogen atom;

each a is a number chosen from 0, 1 and 2;

each b is a number chosen from 0, 1 and 2, wherein the sum a+b is not greater than 2.

* * * * *